US006609792B2

(12) United States Patent
Kaga et al.

(10) Patent No.: US 6,609,792 B2
(45) Date of Patent: Aug. 26, 2003

(54) DATA TRANSMISSION ELEMENT FOR USE IN AN INK-JET PRINTER

(75) Inventors: Hikaru Kaga, Ama-gun (JP); Seiji Shimizu, Ogaki (JP); Tsuyoshi Suzuki, Owariasahi (JP); Katsunori Nishida, Nagoya (JP); Takamasa Usui, Ogaki (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 25 days.

(21) Appl. No.: 10/026,908

(22) Filed: Dec. 27, 2001

(65) Prior Publication Data

US 2002/0080218 A1 Jun. 27, 2002

(30) Foreign Application Priority Data

Dec. 27, 2000 (JP) ..... 2000-398781
Dec. 7, 2001 (JP) ..... 2001-373867

(51) Int. Cl.[7] ..... B41J 2/01
(52) U.S. Cl. ..... 347/104; 347/50; 347/57
(58) Field of Search ..... 347/50, 5, 57

(56) References Cited

U.S. PATENT DOCUMENTS 6,145,961 A 11/2000 Otsuki
6,357,859 B1 * 3/2002 Klees ..... 347/50

FOREIGN PATENT DOCUMENTS

JP 59-73953 A 4/1984
JP 11-28847 A 2/1999
JP 052623 * 2/2000

* cited by examiner

*Primary Examiner*—Lamson Nguyen
*Assistant Examiner*—Ly T Tran
(74) *Attorney, Agent, or Firm*—Oliff & Berridge, PLC

(57) ABSTRACT

An ink-jet printer in which drive data for a print head is converted into a light signal by a first light-emitting diode provided in a control circuit. The light signal is transmitted, through an optical fiber, to a first photo-diode provided in a receiver circuit. The light signal received by the first photo-diode is converted into an electric signal. Data concerning the status of a print head unit is converted into a light signal by a second light-emitting diode provided in the receiver circuit. The light signal is transmitted from the second light-emitting diode, through the optical fiber, to a second photo-diode provided in the control circuit. The light signal received by the second photo-diode is converted into an electric signal.

20 Claims, 7 Drawing Sheets

DATA TRANSMISSION ELEMENT FOR USE IN AN INK-JET PRINTER

BACKGROUND OF THE INVENTION

1. Field of Invention

The invention relates to an ink-jet printer, and more particularly, to an ink-jet printer that transfers large amount of print data speedily and stably.

2. Description of Related Art

A known ink-jet printer of an ink tube supply type is disclosed in Japanese Laid-Open Patent Publication No. 59-73953. Such an ink-jet printer includes a print head unit provided with an ink-jet print head. The ink-jet print head has an ink nozzle from which ink is ejected to perform printing onto a paper sheet. The print head unit is mounted onto a carriage. The carriage is driven by a motor to move the print head unit. Signals for driving the print head are transmitted from a control circuit, through signal input lines of flexible cables.

Referring to FIG. 7, signal flow paths to the print head will be described. FIG. 7 is a block diagram showing signal flow paths between an electric control circuit provided in a printer body and an electric receiver circuit provided in the print head unit. As shown in FIG. 7, a circuit board 20 is provided separately from the carriage in the printer body and includes a control circuit 21 that controls the print head. Another circuit board 22, provided on the carriage, includes a receiver circuit 23 that receives signals transmitted from the control circuit 21. The control circuit 21 and the receiver circuit 23 are connected by various signal lines. The signal lines connected to control circuit 21 and the receiver circuit 23 are, for example, a power supply wire V1 that carries the voltage (30 V) required to drive actuators of piezoelectric elements, and a power supply wire V2 that carries the voltage (5 V) required to drive a control circuit provided in the receiver circuit 23, as well as a flexible flat cable formed of an insulating sheet on which a plurality of image signal lines S1 to Sn are printed with an electrically conductive material.

In the above-described print head, when respective drive voltages are applied through the power supply wires V1, V2, and signals are provided to the image signal lines S1 to Sn, in the state that an ink passage is filled with ink, a voltage is applied to corresponding actuators. Accordingly, the actuators are deformed so as to instantaneously decrease the volumetric capacity of the ink passage. As a result, the ink in the ink passage is ejected from the ink nozzles in the form of a droplet.

In recent years, it has been required that a large amount of data be transmitted to the print head at high speed, to accommodate a multi-level gray scale printing, as well as high-speed, high-quality, high-resolution and multi-color printing, as is performed in the ink-jet printer using six colors of ink disclosed in, for example, U.S. Pat. No. 6,145,961. If the number of the ink nozzles needs to be increased or the number of the signal lines is increased to accommodate the multi-level gray-scale printing, the cable including the signal lines S1 to Sn becomes wide. Such a wide cable prevents the carriage from moving smoothly and can even make the physical size of the printer larger. When a large amount of data is transmitted at high speed through the electrically conductive signal lines, a signal waveform is affected by the electromagnetic interference, or radiant noise is generated to the outside. When the electric signals are transmitted at high frequencies equal to or greater than 100 MHz through the electrically conductive signal lines, a shield device is required as a remedy to the radiant noise.

When an ink-jet printer has a signal flow path to transmit data concerning the status of the print head unit, including the print head, such as the heat generated in the driver circuit board by driving the print head, the amount of ink remaining in an air trap unit, and the presence or absence of air in the air trap unit, from the receiver circuit 23 to the control circuit 21, an additional signal line is required to transmit the data. Such an increase in the number of the signal lines leads to the printer becoming large in size.

SUMMARY OF THE INVENTION

In the light of the foregoing, it is desirable to provide a compact ink-jet printer that controls a print head unit thereof according to the conditions of the print head unit, and to enable a large amount of data to be transmitted speedy and stably.

According to one aspect of the invention, an ink-jet printer may include a printer body; a print head unit that includes a print head for performing printing onto a recording medium and a carriage on which the print head is mounted; a control circuit that is provided in the printer body separately from the print head and controls the print head unit; a receiver circuit that is provided on the carriage and receives a signal from the control circuit; a first transmission member that converts drive data for the print head into a light signal, transmits the light signal, and is provided in the control circuit; a first reception member that receives the light signal transmitted from the first transmission member and converts the light signal into an electric signal and is provided in the receiver circuit; a second transmission member that converts status data for the print head unit into a light signal and transmits the light signal and is provided in the receiver circuit; a second reception member that receives the light signal transmitted from the second transmission member and converts the light signal into an electric signal and is provided in the control circuit; and an optical fiber through which the light signal from the first transmission member and the second transmission member is transmitted to the first reception member and the second reception member, respectively.

BRIEF DESCRIPTION OF THE DRAWINGS

The invention will be described in greater detail with reference to an embodiment thereof and the accompanying drawings wherein.

DETAILED DESCRIPTION OF PREFERRED EMBODIMENTS

Figure 1:
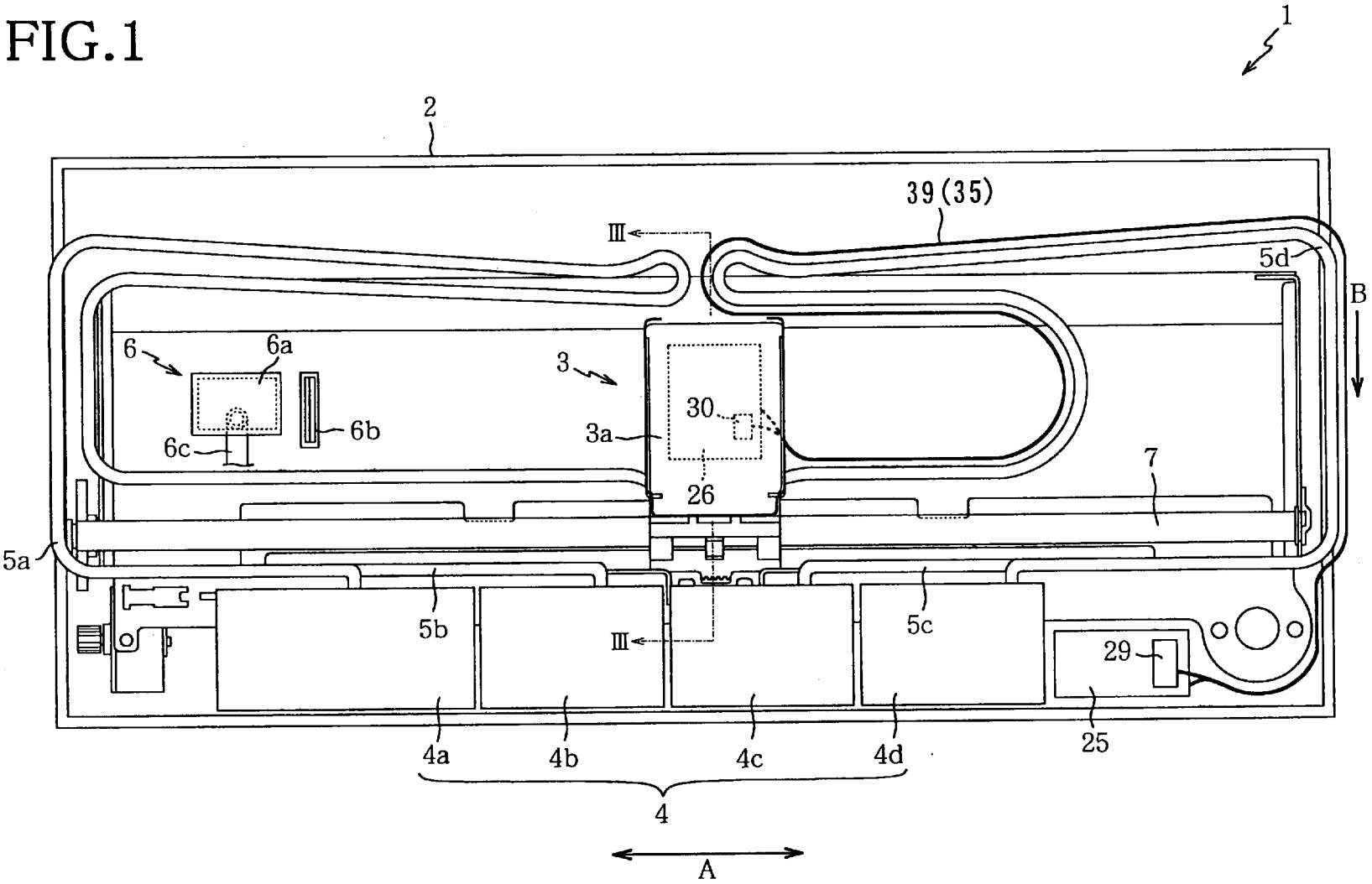
FIG. 1 is a side view of an ink-jet printer according to an embodiment of the invention.

FIG. 1 is a side view of an ink-jet printer 1 according to an embodiment of the invention. As shown in FIG. 1, the ink-jet printer 1 includes a printer body 2 formed of flame-retardant plastic and substantially in the shape of a box, a print head unit 3 removably mounted in the printer body 2, ink tanks 4*a*–4*d*, which may be collectively referred to as the ink tank 4, tubes 5*a*–5*d* interconnecting the print head unit 3 and the corresponding ink tanks 4*a*–4*d*, a purge device 6, a guide rod 7, a control circuit board 25, a first photoelectric converter 29 mounted on the control circuit board 25, a receiver circuit board 26, a second photoelectric converter 30 mounted on the receiver circuit board 26, and a harness 39 including an optical fiber 35 and power supply wires.

The print head unit 3 is equipped with a plurality of print heads, each of which ejects ink onto a paper sheet for printing. The print head unit 3 is in fluid communication with the ink tanks 4*a*–4*d* provided at a lower part of the printer body 2, via the tubes 5*a*–5*d*, and receives ink from the ink tanks 4*a*–4*d*. The print head unit 3 is installed on a carriage 3*a*, which is attached to a belt (not shown). The belt is looped around a roller (not shown) attached to a motor (not shown). When the motor runs, the belt is driven, which allows the carriage 3*a* mounting the print head unit 3 thereon to move for the distance the belt is driven. The print head unit 3 will be described in more detail below, with reference to FIG. 2.

The guide rod 7 is slidably inserted into holes formed in the carriage 3*a*, so that the carriage 3*a* is movably supported in the direction A (FIG. 1) orthogonal to a feeding direction of a paper sheet. The print head unit 3 mounted on the carriage 3*a* reciprocates in the direction A parallel to the guide rod 7, that is, in the longitudinal direction of the printer body 2.

The ink tank 4 that stores ink to be supplied to the print head unit 3 is disposed below the print head unit 3. The ink tank 4 in this embodiment includes four ink tanks 4*a*–4*d* to store black, yellow, cyan, and magenta ink in the identified order from left to right in FIG. 1. One end of each of the tubes 5*a*–5*d* is attached to the corresponding ink tank 4*a*–4*d*, so as to supply the respective color ink of black, yellow, cyan and magenta, to the print head unit 3. The other end of each of the tubes 5*a*–5*d* is connected to the print head unit 3. The ink contained in the ink tanks 4*a*–4*d* is supplied therefrom to the print head unit 3. The respective color ink is ejected from the corresponding print head 15, enabling full-color printing on a paper sheet.

The purge device 6, that performs a purging operation, is disposed on a left end of the printer body 2, as shown in FIG. 1. The purging operation is a process to recover the state of the ink to be ejected from the print heads 15. The purge device 6 is provided with a suction cap 6*a* that can hermetically seal ink nozzles of the print heads 15, a wiper 6*b* that wipes the surface of the ink nozzles, and a suction pump (not shown) that sucks the ink from the suction cap 6*a*, via a discharge tube 6*c*. The purge device 6 may be designed to discharge the ink from the print heads 15 by applying a positive pressure to the ink from the ink tank 4.

When the purging operation is performed with the purge device 6, the motor is driven to move the print head unit 3, mounting the print heads 15 thereon, to the left side of the ink-jet printer 1 as shown in FIG. 1. The ink nozzles of the print heads 15 are hermetically sealed by the suction cap 6*a*. Then, the suction pump is actuated and air bubbles and dried or solidified ink are sucked and discharged from the tube 6*c*. The wiper 6*b* wipes the surface of the print heads 15, so that the state of the ink nozzles is recovered.

Provided inside the printer body 2 is the control circuit board 25. The control circuit board 25 includes a central processing unit (CPU), a read-only memory (ROM), a random-access memory (RAM) and other control devices that control the print head unit 3, according to control programs related to operations of the print head unit 3. Further, the control circuit board 25 includes the first photoelectric converter 29 that converts a light signal and an electric signal.

The print head unit 3 mounted on the carriage 3*a* includes the receiver circuit board 26 on which the second photoelectric converter 30 that converts a light signal and an electric signal is mounted. The harness 39 is connected to the control circuit board 25 and the receiver circuit board 26. The optical fiber 35 is connected to the first and second photoelectric converters 29, 30. Through the single optical fiber 35, the light signal from the first photoelectric converter 29 or the second photoelectric converter 30 is transmitted to the second photoelectric converter 30 or the first photoelectric converter 29. The harness 39 is disposed along the tube 5*d*.

Figure 2:
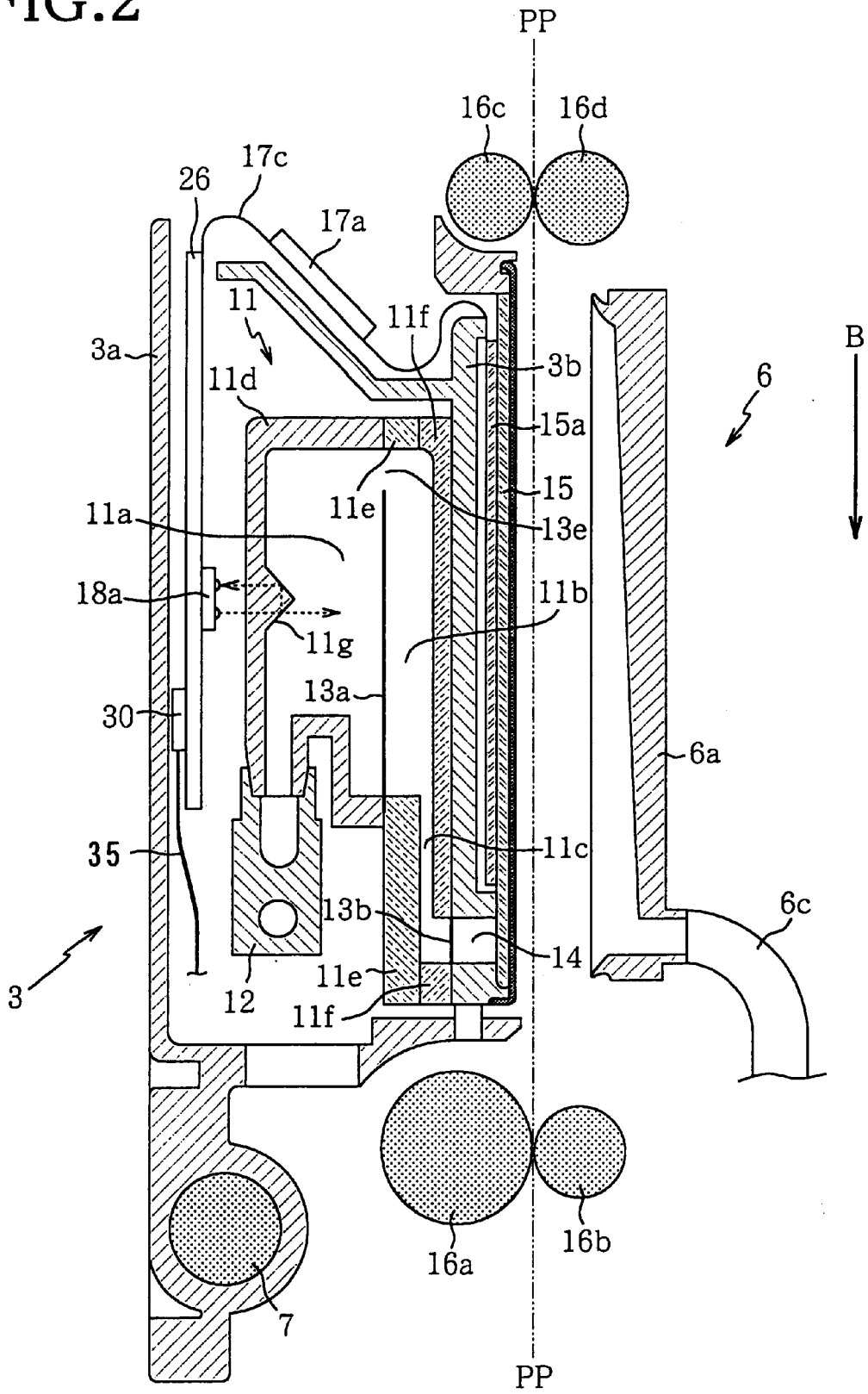
FIG. 2 is a sectional view of a print head unit including an air trap unit, a purge device and feed rollers.

FIG. 2 is a sectional view of the ink-jet printer 1 including the print head unit 3, taken along the line III—III shown in FIG. 1. As shown in FIG. 2, paper feed rollers 16*a*–16*d* are provided to feed a paper sheet PP during printing. Two paper feed rollers 16*a*, 16*b* and the other two paper feed rollers 16*c*, 16*d* are disposed below and above the print head unit 3 in FIG. 2, respectively. The paper feed rollers 16*a*–16*d* are driven by signals input from the control circuit board 25 mounted in the printer body 2, to feed the paper sheet PP in the direction perpendicular to the moving direction A of the print heads 15. More specifically, the paper sheet PP is fed from the lower side in FIG. 2 to the upper side, that is, opposite to the vertical direction B. The paper feed line of the paper sheet PP is indicated by alternate dots and dash lines in FIG. 2.

The print head unit 3 is disposed at a position facing and parallel to the paper feed line along which the paper sheet PP is carried by the paper feed rollers 16*a*–16*d*. The print head unit 3 is provided, on the paper sheet feeding side, with a plurality of the print heads 15. A plurality of air trap units 11, an air trap unit 11 for each print head 15, are provided in the moving direction A of the carriage 3*a*.

The print heads 15 are provided with a plurality of ink nozzles facing the paper sheet PP. The ink is delivered to ink channels from corresponding air trap units 11 and ejected from the ink nozzles by the deformation of actuators 15*a* of piezoelectric elements.

The print heads 15 are connected to the air trap units 11 supported by a body 3*b* of the print head unit 3, through connecting passages 14. Each air trap unit 11 is divided into a first chamber 11*a* and a second chamber 11*b*, by a first filter 13*a* and extends vertically along the body 3*b*, as shown in FIG. 2.

The first chamber 11*a* is separated by the first filter 13*a* and is located on the side of the ink tank 4, upstream of the ink passage. The first filter 13*a* separates the two chambers 11*a*, 11*b*, and an opening 13*e* provided at an upper portion of the first filter 13*a* is left open. The ink supplied from the ink tank 4 through the tubes 5*a*–5*d* is introduced into the first chamber 11*a* through a joint member 12 connected to the bottom portion of the first chamber 11*a*. The flow of the ink introduced into the first chamber 11*a* is blocked by the first filter 13*a* and the air contained in the ink rises. The air is trapped at an upper portion of the first chamber 11*a*.

A sensor 18*a* that detects the ink amount or ink level is provided in the receiver circuit board 26, so as to face the first chamber 11*a*, as shown in FIG. 2. The sensor 18*a* is, for example, an optical type and has a light-emitting and photo-receiving element. A prism 11*g* formed of an optically transparent resin material is disposed on a wall of the first chamber 11*a* opposite to the sensor 18*a*. The ink amount or ink level is detected by the relationship between the refractive index of the prism 11*g* with respect to ink and the refractive index of the prism 11*g* with respect to the air. More specifically, when the prism 11*g* contacts the ink in the first chamber 11*a*, the light emitted from the light-emitting element of the sensor 18*a* travels in a straight line through the ink in the first chamber 11*a*. When the ink in the first chamber 11*a* is reduced to expose the prism 11*g*, the light emitted from the light-emitting element of the sensor 18*a* is reflected inside the prism 11*g*, returning to the photo-receiving element of the sensor 18*a*. Thus, the ink amount or ink level in the first chamber 11*a* is detected.

Figure 6:
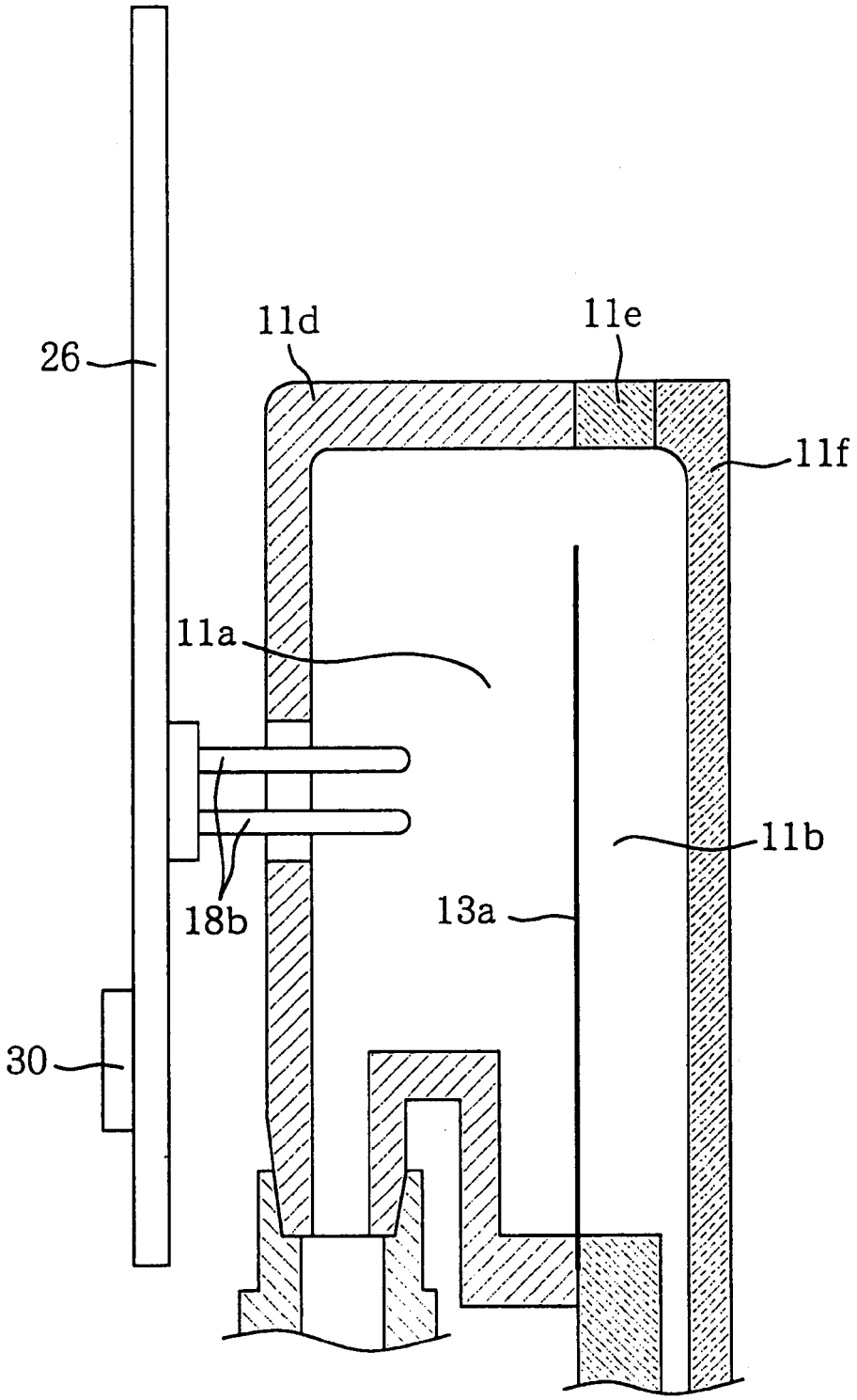
FIG. 6 is a sectional view of a principal portion of the print head unit shown in FIG. 2, showing another type of a sensor for detecting an amount of ink in the air trap unit.
Figure 7:
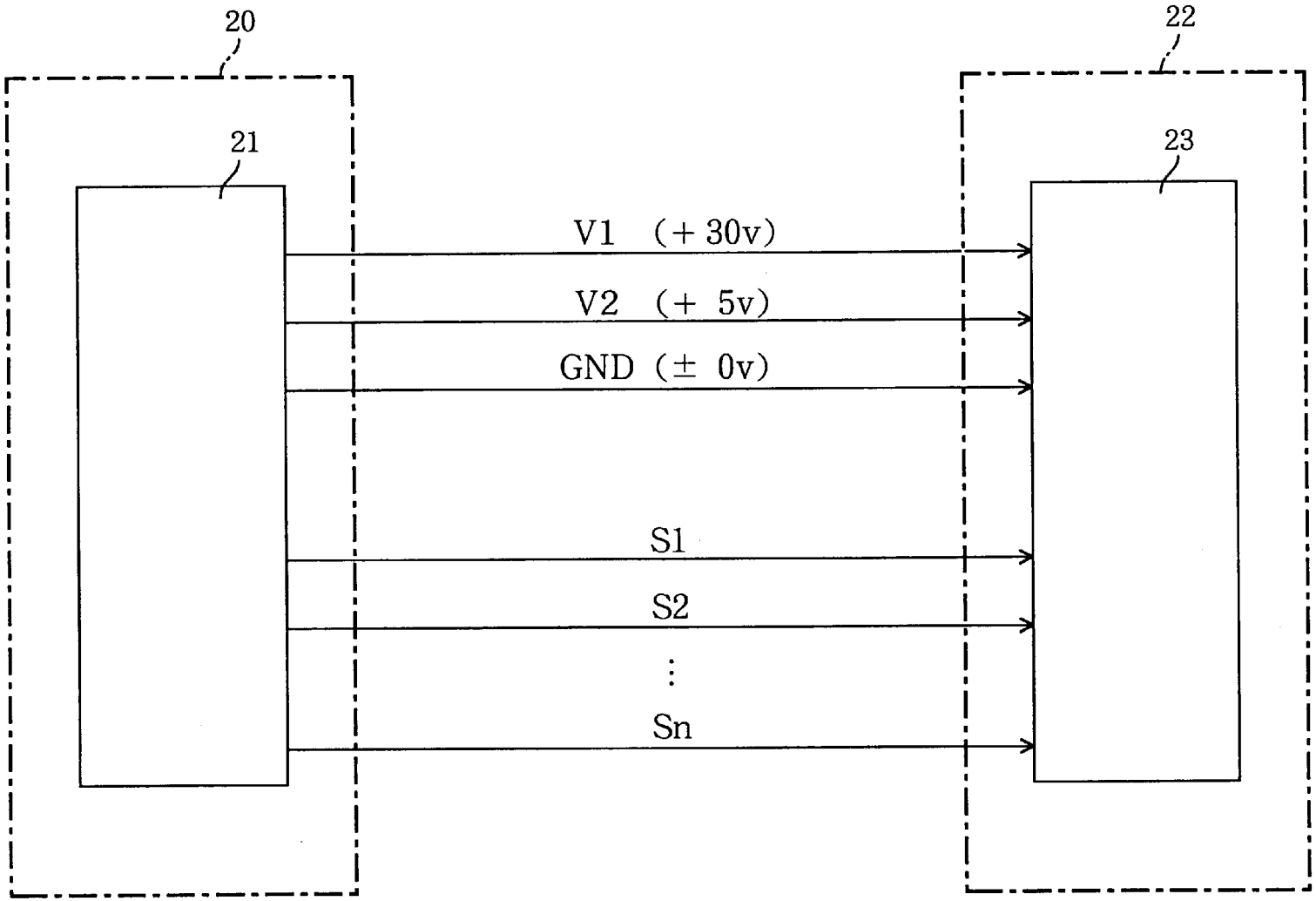
FIG.7 RELATED ART
FIG. 7 is a block diagram showing signal flow paths in a conventional ink-jet printer between a control circuit provided in a printer body and a receiver circuit provided in the print head unit.

As shown in FIG. 6, a sensor having a pair of electrodes 18*b* may be used to detect the ink amount or ink level in the first chamber 11*a*. The electrodes 18*b* of a sensor mounted on the receiver circuit board 26 are inserted into the first chamber 11*a* through a wall thereof. The ink amount or ink level is detected by the impedance difference between the electrodes 18*b* when both of the electrodes 18*b* contact the ink in the first chamber 11*a* and when one of the electrodes 18*b* is exposed. Alternatively, other known structures to detect the amount of ink in the ink tank may be employed.

The thus detected signal is transmitted, through the optical fiber 35, to the control circuit board 25 provided in the printer body 2. When a resistance change is detected from the signals sent to the control circuit board 25, it is determined that air trapped in the air trap unit 11 has exceeded a predetermined volume. Accordingly, the control circuit board 25 sends a signal to the purge device 6, to perform the purging operation. In response to the signal, the purge device 6 conducts the purging operation to remove air trapped in the air trap unit 11.

The second chamber 11*b* is separated by the first filter 13*a* and is located on the side of the print head 15, downstream of the ink passage. As shown in FIG. 2, the second chamber 11*b* is provided at a bottom portion thereof with a guide nozzle 11*c*. The guide nozzle 11*c* is connected to the print head 15, through the connecting passage 14. The ink is supplied from the second chamber 11*b* of each of the air trap units 11 to the corresponding print head 15.

The volume of the second chamber 11*b* is set smaller than that of the first chamber 11*a*. In this embodiment, the volume of the second chamber 11*b* is set at about a half of that of the first chamber 11*a*. When the air trapped in each air trap unit 11 is sucked by the purging operation, all the ink contained in the second chamber 11*b* is discharged. In this embodiment, because the volume of the second chamber 11*b* is smaller than that of the first chamber 11*a*, the amount of ink discharged by the purging operation is minimized. Further, the pressure required to suck ink, that is, to suck air from the second chamber 11*b* is reduced.

An inner wall of the second chamber 11*b* is formed by crystalline resin having high wettability to ink, or the surface of the inner wall is treated so as to improve wettability to ink. Thus, the inner wall of the second chamber 11*b* easily gets wet with ink and the air trapped the air trap unit 11 finds it is difficult to stay at the inner wall of the second chamber 11*b*. Therefore, the air trapped in the air trap unit 11 is discharged easily and quickly through the second chamber 11*b* by the purging operation.

The first filter 13*a*, as described above, divides the lower portion of the air trap unit 11 into the first chamber 11*a* and the second chamber 11*b*, at such a position that the volume of the second chamber 11*b* is set smaller than that of the first chamber 11*a* or about a half of the first chamber 11*a*. The first filter 13*a* extends vertically, parallel to the body 3*b* of the print head unit 3. The first filter 13*a* is a meshed net made of stainless steel having openings with the diameter of, for example, 16 $\mu$m in order to prevent air generated in the ink passage from passing through the first filter 13*a*.

The vertical dimension of the first filter 13*a* (in direction B) is shorter than the vertical inside dimension of the air trap unit 11, to form the opening 13*e*. The opening 13*e* allows the ink to communicate between the first and second chambers 11*a*, 11*b* with less resistance. The first filter 13*a* continues to the opposed inner walls extending in the width direction (direction A) of the air trap unit 11, to prevent air introduced into the first chamber 11*a* from entering, into the second chamber 11*b*. Each of the air trap units 11 and the first filter 13*a* are oriented in the vertical direction. Because the first filter 13*a* does not allow the air to pass through the openings of the meshed net, the air introduced into the air trap unit 11 rises in the first chamber 11*a* and is trapped at an upper portion of the first chamber 11*a*. The first filter 13*a* is made of stainless steel which has good wettability to ink, so that it is difficult for air to stay at the first filter 13*a*. Therefore, the air entering the first chamber 11*a* is easily guided upwardly.

The air trap unit 11 structured as described above can trap the air generated in the ink passage. The air trap unit 11 is formed simply by three parts 11*d*–11*f*, as shown in FIG. 2.

A passage filter 13*b* is provided at the connecting passage 14, which connects the guide nozzle 11*c* of the air trap unit 11 and the print head 15, in order to catch dirt contained in ink being supplied to the print head 15. The passage filter 13*b* is made to cover the connecting passage 14 completely and is thermally welded to the passage 14. The passage filter 13*b* has openings small enough to catch dirt but large enough to pass ink and air during purging.

A driver circuit board 17*a* is provided at a top portion of the body 3*b* of the print head unit 3. The driver circuit board 17*a* is mounted on a flexible printed circuit board 17*c* connected to the actuators 15*a*. The driver circuit board 17*a* is controlled by the control circuit board 25 provided in the printer body 2. More specifically, the driver circuit board 17*a* changes serial signals sent by the control circuit board 25 into parallel signals corresponding to the actuators 15*a*, in order to control the actuators 15*a*.

The receiver circuit board 26 is disposed parallel to the print head 15 so as to interpose the air trap unit 11 between the receiver circuit board 26 and the print head 15. The receiver circuit board 26 is connected to an end of the flexible printed circuit board 17*c*. The receiver circuit board 26 includes a connector that connects a power supply wire from the control circuit board 25 to the driver circuit board 17*a*, a noise reduction circuit, and the second photoelectric converter 30 that converts a light signal and an electric signal.

Figure 3:
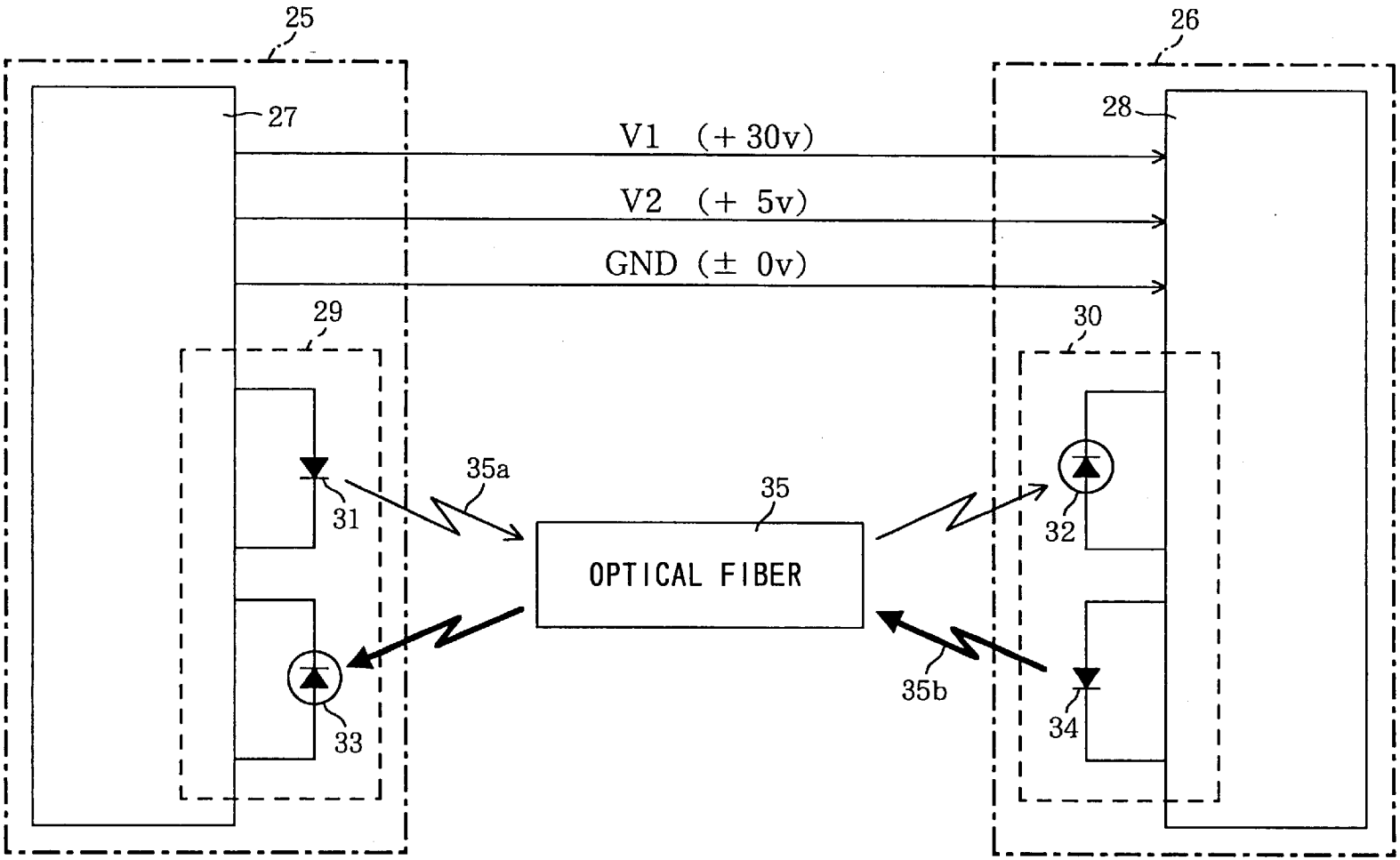
FIG. 3 is a block diagram showing signal flow paths in the ink-jet printer according to the embodiment of the invention, between a control circuit provided in a printer body and a receiver circuit provided for a print head.

Referring to FIG. 3, signal flow paths to the print head unit 3 structured as described above will be described. FIG. 3 is a block diagram showing signal flow paths between an electric control circuit 27 provided in the printer body 2 and an electric receiver circuit 28 provided in the print head unit 3. As shown in FIG. 3, the control circuit board 25 provided, outside of the carriage 3*a*, in the printer body 2 of the ink-jet printer 1 includes the control circuit 27 that controls the print head unit 3. The receiver circuit board 26 provided in the print head unit 3, which is mounted on the carriage 3*a*, includes the receiver circuit 28 that receives the signal transmitted from the control circuit 27. The control circuit 27 includes a first light-emitting diode (LED) 31 that converts an electric signal of drive data for the print heads 15 into a light signal 35*a* and transmits the light signal 35*a* to a first photodiode 32, and a second photo-diode 33 that receives a light signal 35*b* transmitted from a second light-emitting diode (LED) 34 and converts the light signal 35*b* into an electric signal. The receiver circuit 28 includes the second LED 34 that converts an electric signal of data concerning the status of the print head unit 3, such as the heat generated in the driver circuit board 17*a* by driving the print heads 15, the amount of ink remaining in the air trap unit 11, and the presence or absence of the air in the air trap unit 11, into the light signal 35*b* and transmits the light signal 35*b* to the second photo-diode 33, and the first photo-diode 32 that receives the light signal 35*a* transmitted from the first LED 31 and converts the light signal 35*a* into an electric signal. The light signals 35*a*, 35*b* are transmitted through a single optical fiber 35.

The signal flow is not limited to only one direction such that the drive data for the print heads 15 is transmitted from the control circuit 27 and received by the receiver circuit 28. The signal also flows in the direction from the receiver circuit 28 to the control circuit 27 to transmit the data concerning the status of the print head unit 3, so that the data is transmitted bidirectionally. The control circuit 27 receives the status data of the print head unit 3 and controls the print head unit 3 according to the status or condition of the unit 3.

For example, when the print heads 15 are driven for a long period of time, the driver circuit board 17*a* is heated. The extent to which the driver circuit board 17*a* is heated varies depending on the outside air temperature, print data size, and continuous usage of the ink-jet printer 1. The temperature of the driver circuit board 17*a* is detected by a sensor mounted thereon. The temperature data of the driver circuit board 17*a* is transmitted from the second LED 34 to the second photo-diode 33. Thus, the control circuit 27 performs control so as to prevent the temperature of the driver circuit board 17*a* from rising, for example, by restricting the transmission of the drive data for the print heads 15.

The purging operation is performed periodically to recover the state of the ink to be ejected from the print heads 15. If the purging operation is performed even when air is not trapped in the air trap unit 11, the ink in the air trap unit 11 is unnecessarily discharged and wasted. To prevent such a situation, when the sensor 18*a* (FIG. 2) detects that a predetermined amount of air is trapped in the air trap unit 11, a detection signal is transmitted from the second LED 34 to the second photo-diode 33 to request the control circuit 27 to perform the purging operation. Therefore, the purging operation is performed only when it is required, i.e., only when the state of the ink to be ejected from the print heads 15 needs to be recovered. Consequently, ink is not unnecessarily discharged or wasted.

The drive data for the print heads 15, converted into the light signal 35*a* by the first LED 31, and the status data of the print head unit 3, converted into the light signal 35*b* by the second LED 34, are received by the first and second photo-diodes 32, 33, respectively, through the optical fiber 35. Therefore, the data converted into the light signals 35*a*, 35*b* can be transmitted more speedily and stably through the optical fiber 35, without being affected by the ink or paper powders inside the ink-jet printer 1.

The control circuit 27 and the receiver circuit 28 are interconnected by the single optical fiber 35. A flexible electrical cable including a power supply wire V1 that carries voltage (30 V) required to drive the actuators 15*a* of piezoelectric elements, a power supply wire V2 that carries voltage (5 V) required to drive a control circuit provided in the receiver circuit 28, and a ground (GND) wire, are connected to the control circuit 21 and the receiver circuit 28. The single optical fiber 35 through which the drive data for the print heads 15 and status data of the print head unit 3 are transmitted, and the flexible cable including the power supply wires V1, V2 through which the electric signals are transmitted, are disposed parallel to each other. The optical fiber 35 and the flexible cable may be put together or separated.

Figure 4:
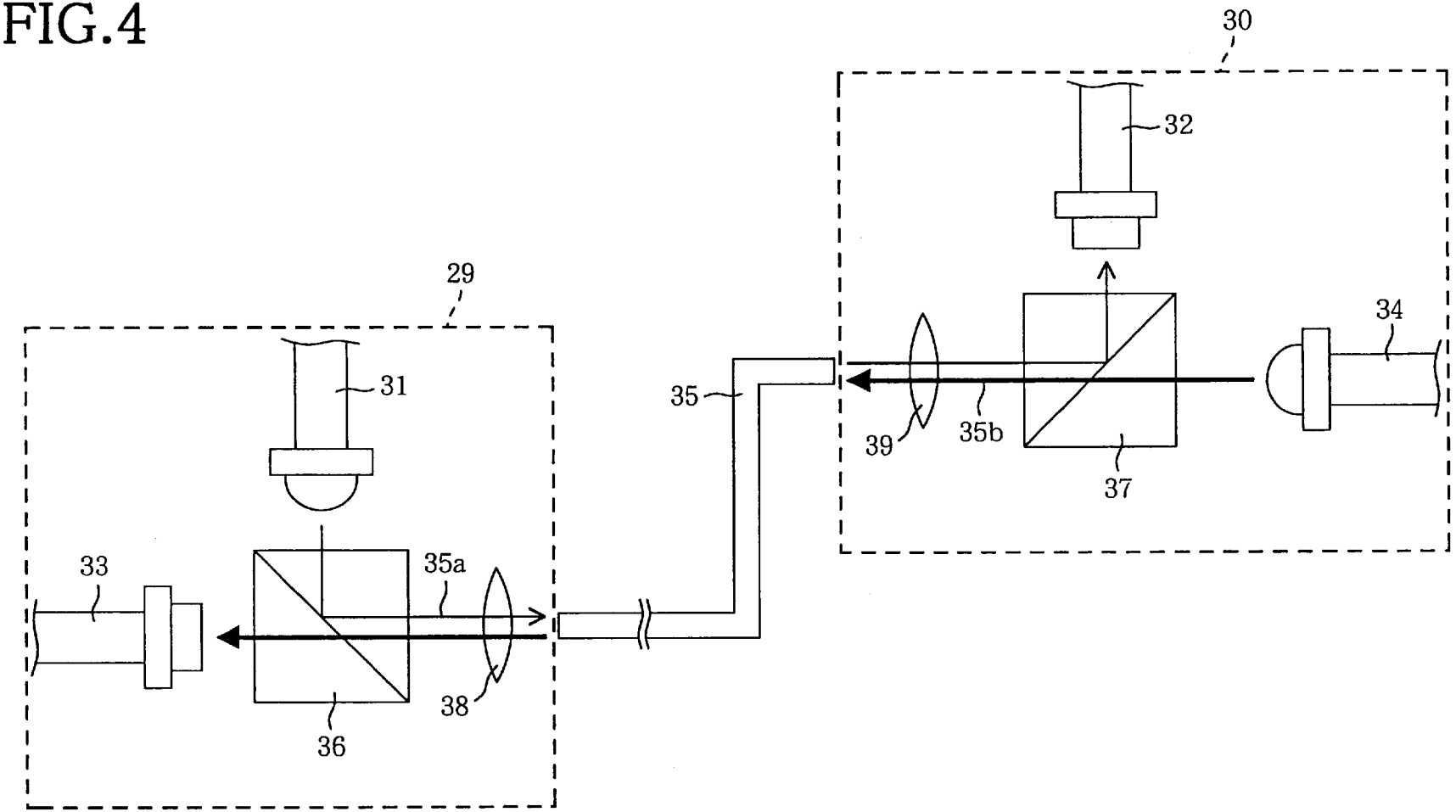
FIG. 4 is a schematic illustration showing the structure of the photoelectric converters.

FIG. 4 illustrates a structure of the photoelectric converters 29, 30. As shown in FIG. 4, the first photoelectric converter 29 provided in the control circuit 27 includes the LED 31, the second photo-diode 33, a half mirror 36, and a condenser 38. Similarly, the second photoelectric converter 30 provided in the receiver circuit 28 includes a second LED 34, the first photo-diode 32, a half mirror 37, and a condenser 39. The first and second photoelectric converters 29, 30 are connected to each other through the single optical fiber 35.

An electric signal of the print head drive data from the control circuit 27 is converted into the light signal 35*a* by the first LED 31. The light signal 35*a* transmitted from the first LED 31 is reflected by the half mirror 36 and converged by the condenser 38. Then, the light signal 35*a* is transmitted to the photoelectric converter 30 provided in the receiver circuit 28, through the optical fiber 35. In the photoelectric converter 30, the first photodiode 32 associated with the first LED 31 is provided on the reflecting side of the half mirror 37. Therefore, the light signal 35*a* transmitted from the first LED 31 is reflected by the half mirror 37 and received by the first photo-diode 32.

An electric signal of the data concerning the status of print head unit 3 from the receiver circuit 28 is converted into the light signal 35*b* by the second LED 34. The light signal 35*b* transmitted from the second LED 34 passes through the half mirror 37 and is converged by the condenser 39. Then, the light signal 35*b* is transmitted to the photoelectric converter 29 provided in the control circuit 27, through the optical fiber 35.

The electric signal of the status data of the print head unit 3 from the receiver circuit 28 is converted into the light signal 35*b* by the second LED 34. Then, the converted light signal 35*b* passes through the half mirror 37 and is converged by the condenser 39. The signal 35*b* is transmitted to the first photoelectric converter 29, provided for the control circuit 27, through the optical fiber 35. The second photo-diode 33 associated with the second LED 34 is provided on the permeative side of the half mirror 36. Therefore, the light signal 35*b* transmitted from the second LED 34 passes through the half mirror 36 and is received by the second photo-diode 33.

The half mirrors 36, 37 are provided at end sides of the optical fiber 35, so that the bidirectional or interactive communication between two pairs of the LEDs and photo-diodes 31, 32 and 34, 33 can be performed. The half mirror 36, the first LED 31, and the second photo-diode 33 are integrally formed, realizing the compact first photoelectric converter 29. Similarly, the compact second photoelectric converter 30 is realized.

In this embodiment, the first LED 31 and the first photo-diode 32 that transmit or receive the drive data for the print heads 15 are provided on the reflecting side of the half mirrors 36, 37. The second LED 34 and the second photo-diode 33 that transmit or receive the status data of the print head unit 3 are provided on the permeative side of the half mirrors 36, 37. However, the first LED 31 and the first photo-diode 32 can be provided on the permeative side of the half mirrors 36, 37, and the second LED 34 and the second photo-diode 33 can be provided on the reflecting side of the half mirrors 36, 37.

The drive data for the ink-jet print heads transferred from an electric control circuit to an electric receiver circuit will be described below.

For example, the ink-jet printer 1 has four print heads 15, each of which include 300 ink nozzles, for printing using four colors of ink, and an ejection frequency (driving frequency) of 36 kHz. When a print dot of each color is 3-bit data for printing at 16-levels of gray scale, a data transfer rate per unit time is calculated as follows:

$$4 \text{ colors} \times 300 \text{ nozzles} \times 36\ kHz \times 3 \text{ bits} = 129.6 \text{ Mbits/s}.$$

When such data is transmitted as electric signals through electrically conductive signal lines, as is done in a known ink-jet printer, parallel processing is performed to send a parallel bit of data through, for example, 32 electrically conductive signal lines. Thus, the frequency of the data transfer per signal line is lowered to approximately 4 MHz. If the data is transmitted through the optical fiber 35, a large amount of data can be transferred through the single optical fiber 35, without using the increased number of the signal lines.

Similarly, the data transfer rate in the following conditions is calculated. An ink-jet printer includes, for example, six print heads, each of which has 1500 ink nozzles, for printing using six colors of ink and an ejection frequency (driving frequency) of 100 kHz. A print dot of each color is 4-bit data for printing at 32-levels of gray scale.

$$6 \text{ colors} \times 1500 \text{ nozzles} \times 100\ kHz \times 4 \text{ bits} = 3.6 \text{ Gbits/s}.$$

If such data is transmitted through the 32 electrically conductive signal lines, as is done in a known ink-jet printer, the data needs to be transferred at a frequency of 112.5 MHz. In this case, it is difficult to reduce the radiant noise to an allowable level without using a shield device. The ink-jet printer 1, according to the embodiment of the invention, employing the optical fiber 35 can cope with the data transfer rate of 3.6 Gbits/s without using the shield device. Further, the ink-jet printer 1 provided with the optical fiber 35 can cope with the higher data transfer rate without generating radiant noise to the outside.

Figure 5A:
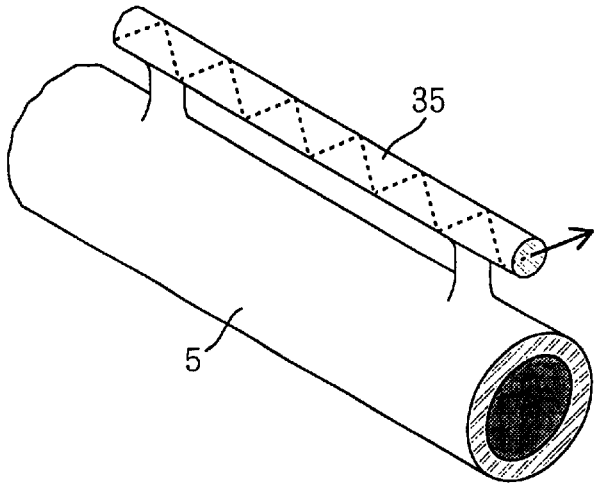
FIGS. 5A to 5C are schematic illustrations showing arrangements of an optical fiber and a tube.
Figure 5B:
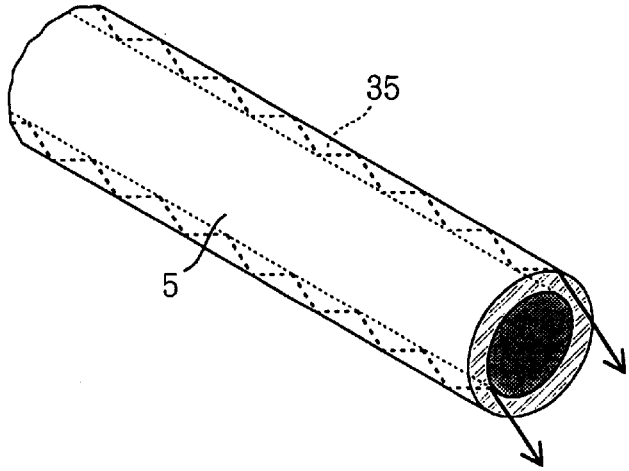
Figure 5C:
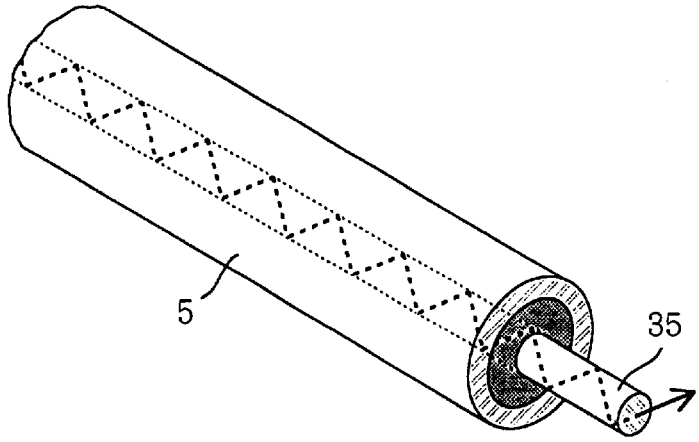

Referring to FIGS. 5A through 5C, arrangements of the optical fiber 35 and the tube 5 that supplies ink are described. In FIG. 5A, the outer surface of the optical fiber 35 is attached to connecting portions extending from the outer wall of the tube 5, with a certain distance between the connecting portions. Thus, the optical fiber 35 and the tube 5 are formed into one piece, with a signal flow path and the ink passage gathered. The outer member of the tube 5 and the optical fiber 35 may be integrally formed.

In FIG. 5B, the ink passage is provided in the optical fiber 35 formed into a hollow shape. With this structure, the tube 5 for the ink passage does not have to be provided separately. Therefore, the number of parts used can be reduced, leading to facilitated manufacturing processes. The light signal path and ink passage are integrated into one component.

In FIG. 5C, the tube 5 is provided so as to surround the optical fiber 35. With this structure, a space for the optical fiber 35 does not have to be provided separately. Therefore, the optical fiber 35 and the tube 5 can be provided in a small or limited area.

As described above, in the ink-jet printer 1 according to the embodiment, the second LED 34 provided in the receiver circuit 28 transmits the status data of the print head unit 3, such as the heat generated in the driver circuit board 17*a* by driving the print heads 15, the amount of the ink remaining in the air trap unit 11, and the presence or absence of trapped air in the unit 11, to the second photo-diode 33 provided in the control circuit 27. The signals are transmitted bidirectionally or interactively, without limiting the signal flow to only one direction from the control circuit 27 to the receiver circuit 28. The electric signal of the data is converted into a light signal and the light signal is transmitted. Therefore, a large number of signal lines does not have to be provided in comparison to the case where data is transmitted by electric signal, even when a large amount of data is transmitted. Accordingly, the space for providing lots of signal lines is saved and consequently, a compact ink-jet printer 1 can be provided.

It should be understood that the invention is not limited in its application to the details of structure and arrangement of parts illustrated in the accompanying drawings. The invention is capable of other embodiments and of being practiced or performed in various ways without departing from the technical idea thereof, based on existing and well-known techniques among those skilled in the art.

For example, the above embodiment is described with the ink-jet printer 1 of an ink tube supply type. However, in a printer that mounts an ink tank on a carriage, the amount of ink remaining in the ink tank may be detected by a sensor. Data of the remaining ink may be transmitted from a light-emitting diode provided in a receiver circuit to a control circuit provided in a printer body. The control circuit may be configured to determine whether printing is started according to the size of the print data. Thus, the ink shortage during printing may be avoided.

What is claimed is:

1. An ink-jet printer, comprising:

a printer body;

a print head unit that includes a print head for performing printing onto a recording medium and a carriage on which the print head is mounted;

a control circuit that is provided in the printer body separately from the print head and controls the print head unit;

a receiver circuit that is provided on the carriage and receives a signal from the control circuit;

a first transmission member that converts drive data for the print head into a light signal and transmits the light signal, the first transmission member being provided in the control circuit;

a first reception member that receives the light signal transmitted from the first transmission member and converts the light signal into an electric signal, the first reception member being provided in the receiver circuit;

a second transmission member that converts status data for the print head unit into a light signal and transmits the light signal, the second transmission member being provided in the receiver circuit;

a second reception member that receives the light signal transmitted from the second transmission member and converts the light signal into an electric signal, the second reception member being provided in the control circuit; and an optical fiber through which the light signal from the first transmission member and the second transmission member is transmitted to the first reception member and the second reception member, respectively.

2. The ink-jet printer according to claim 1, wherein the optical fiber is a single optical fiber.

3. The ink-jet printer according to claim 2, further comprising a half mirror that is provided to each end of the optical fiber, wherein either a pair of the first transmission member and the first reception member or a pair of the second reception member and the second transmission is disposed at a position where the light signal to be transmitted or transmitted through the optical fiber is reflected by the half mirror, and the other pair of the first transmission member and the first reception member or the pair of the second reception member and the second transmission is disposed at a position where the light signal to be transmitted or transmitted through the optical fiber passes through the half mirror.

4. The ink-jet printer according to claim 2, wherein the print head includes ink nozzles and performs printing by ejecting ink from the ink nozzles, wherein the ink-jet printer further comprises:

an ink tank that is provided separately from the carriage and stores the ink to be supplied to the print head; and an ink passage that connects the ink tank and the print head to supply the ink from the ink tank to the print head, the ink passage being formed by a flexible tube, wherein the optical fiber is disposed parallel to the ink passage.

5. The ink-jet printer according to claim 4, wherein the optical fiber has the ink passage therein.

6. The ink-jet printer according to claim 4, wherein the optical fiber is disposed in the ink passage.

7. The ink-jet printer according to claim 4, further comprising:

an ink chamber that is mounted on the carriage and is connected to the print head and the ink tube to store the ink supplied from the ink tank;

a purge device that discharges air stored in the ink chamber from the ink nozzles; and a detecting device that detects whether a predetermined level of the air is stored in the ink chamber, wherein the control circuit further comprises a purge control circuit that actuates the purge device when the detecting device detects that the predetermined level of the air is stored in the ink chamber, and the second transmission member converts a detection signal of the detecting device as the status data for the print head unit into the light signal and transmits the light signal to the control circuit.

8. The ink-jet printer according to claim 1 wherein frequency of the drive data is 100 MHz or greater.

9. The ink-jet printer according to claim 8, wherein the print head is provided for each of color of ink, the print head for each of color of ink includes 1500 ink nozzles or greater and performs printing by ejecting the ink at frequencies of 100 kHz or greater for 32 or greater levels of gray scale.

10. An ink-jet printer, comprising:

a printer body;

a print head that performs printing onto a recording medium by ejecting ink from ink nozzles;

a print head unit that includes a carriage on which the print head is mounted and that moves along the recording medium;

an ink tank that is provided separately from the carriage and stores the ink to be supplied to the print head;

a flexible tube that connects the ink tank and the print head to supply the ink from the ink tank to the print head;

a control circuit that is provided in the printer body separately from the print head and controls the print head unit;

a receiver circuit that is provided on the carriage and receives a signal from the control circuit;

a first transmission member that converts drive data for the print head into a light signal and transmits the light signal, the first transmission member being provided in the control circuit;

a first reception member that receives the light signal transmitted from the first transmission member and converts the light signal into an electric signal, the first reception member being provided in the receiver circuit;

a second transmission member that converts status data for the print head unit into a light signal and transmits the light signal, the second transmission member being provided in the receiver circuit;

a second reception member that receives the light signal transmitted from the second transmission member and converts the light signal into an electric signal, the second reception member being provided in the control circuit; and an optical fiber through which the light signal from the first transmission member and the second transmission member is transmitted to the first reception member and the second reception member, respectively.

11. The ink-jet printer according to claim 10, further comprising:

an ink chamber that is mounted on the carriage and is connected to the print head and the ink tube to store the ink supplied from the ink tank;

a purge device that discharges air stored in the ink chamber from the ink nozzles; and a detecting device that detects whether a predetermined level of the air is stored in the ink chamber, wherein the control circuit further comprises a purge control circuit that actuates the purge device when the detecting device detects that the predetermined level of the air is stored in the ink chamber, and the second transmission member converts a detection signal of the detecting device as the status data for the print head unit into the light signal and transmits the light signal to the control circuit.

12. The ink-jet printer according to claim 11, wherein the optical fiber is disposed parallel to the ink passage.

13. The ink-jet printer according to claim 12, wherein the optical fiber has the ink passage therein.

14. The ink-jet printer according to claim 12, wherein the optical fiber is disposed in the ink passage.

15. A data transmitting apparatus for use in a print device using a liquid ink transported through a tube from an ink tank to a print head, the data transmitting apparatus comprising:

a first photo-electric converter having:

a first LED;

a second photo-diode; and a first half mirror opposing both the first LED and the second photodiode; and a second photo-electric converter having:

a second LED;

a first photo-diode; and a second half mirror opposing both the second LED and the first photodiode; and an optical fiber linking the first photoelectric-converter and the second photoelectric converter to provide a bi-directional data flow path.

16. The data transmitting apparatus according to claim 15, wherein a one of an output light signal from the first LED to the first photo-diode and an output light signal from the second LED to the second photo-diode passes through the first and second half mirrors and the other of the output light signal from the first LED to the first photo-diode and the output light signal from the second LED to the second photo-diode is reflected by both the first and second half mirrors.

17. The data transmitting apparatus according to claim 15, wherein the optical fiber is attached to an outer surface of the tube.

18. The data transmitting apparatus according to claim 15, wherein the optical fiber forms the tube.

19. The data transmitting apparatus according to claim 15, wherein the optical fiber transits an interior of the tube.

20. The data transmitting apparatus according to claim 15, further comprising:

a first condenser lens between the first half mirror and an end of the optical fiber; and a second condenser lens between the second half mirror and the other end of the optical fiber.

* * * * *